United States Patent [19]
Hume
[11] 4,317,636
[45] Mar. 2, 1982

[54] RIBBON CARTRIDGE

[75] Inventor: James G. Hume, Hayward, Calif.
[73] Assignee: Xerox Corporation, Stamford, Conn.

[21] Appl. No.: 165,514
[22] Filed: Jul. 3, 1980
[51] Int. Cl.[3] ..... B41J 25/38
[52] U.S. Cl. ..... 400/208; 400/196
[58] Field of Search ..... 400/194–196, 400/207, 208; 242/197–200

[56] References Cited

U.S. PATENT DOCUMENTS

| | | | |
|---|---|---|---|
| 3,386,676 | 6/1968 | Sotani et al. | 242/200 |
| 3,528,626 | 9/1970 | Bumb | 400/208 X |
| 3,643,779 | 2/1972 | Anderson et al. | 242/197 X |
| 3,731,781 | 5/1973 | Caudill et al. | 400/208 |
| 4,010,839 | 3/1977 | Guerrini et al. | 400/208 X |
| 4,034,935 | 7/1977 | Plaza et al. | 400/208 X |
| 4,047,608 | 9/1977 | Willcox | 400/208 |
| 4,123,789 | 10/1978 | Shatavsky | 242/199 X |
| 4,272,202 | 6/1981 | Schroeder et al. | 400/235.1 X |

*Primary Examiner*—Paul T. Sewell
*Attorney, Agent, or Firm*—Serge Abend

[57] ABSTRACT

An improved ribbon cartridge for use in impact printers, typewriters or the like, in which inked ribbon upon a supply spool and a take-up spool are enclosed within a housing with the center of each spool being supported for rotation and for floating movement along its own guide path. A guide capstan having a fixed center is also located within the housing. The supply spool is mounted upon a torsion arm for movement in an arcuate path and is urged toward and against the take-up spool which itself is constrained to move in a straight line between the takeup spool and the fixed center drive capstan. When the capstan is rotated by an external drive, it rotates the take-up spool in order to wind the inked ribbon thereupon while simultaneously unwinding ribbon from the supply spool.

7 Claims, 6 Drawing Figures

RIBBON CARTRIDGE

The ribbon cartridge of this invention is an improvement over the basic design of the ribbon cartridge fully described in copending application Ser. No. 165,513 filed on July 3, 1980 and entitled "High Capacity Ribbon Cartridge With Surface Drive", filed in the names of Bernard D. Benz, Edward Michael Carlin, Jr. and Thomas Daniel Gross and assigned to the same assignee as the instant application.

In the copending application, a novel floating center surface driven ribbon cartridge arrangement is set forth. That cartridge represents a prototype design developed to prove the advantages and satisfactory operation of the unique arrangement.

The ribbon cartridge of the instant invention has been developed for use in the Diablo Systems, Inc. (a subsdiairy of assignee) HyType II (registered Trademark of Xerox Corporation) printer. At present the HyType II printer accepts two ribbon cartridge configurations designed for it. One is an endless fabric cartridge as shown in U.S. Pat. No. Des. 244,965. The other is a plastic film ribbon cartridge as shown in U.S. Pat. No. Des. 245,116 and in U.S. Pat. No. 4,034,935.

The fabric ribbon cartridge contains a continuous loop of ink impregnated cloth ribbon stuffed into the housing with a useful span extending through and between exit and inlet horns. The fabric ribbon continually cycles past the impact zone during operation of the printer. With this type of ribbon, new cartridges print darker and wider when fresh and gradually lose density with use. The user is left to determine, from the density of the print, when it is time to change the cartridge.

The plastic film ribbon cartride is of the conventional reel-to-reel type wherein the cartridge is discarded when all the ribbon has despooled from the supply spool and has been collected upon the take-up spool. Therefore, it is desired to maximize the number of characters which may be printed before the cartridge is exhausted. Two factors controlling the number of characters are, the ribbon length housed within the cartridge and, the amount of incremental ribbon advance per character. An attempt had been made in the known plastic film cartridge embodiment of U.S. Pat. No. 4,034,935 to increase the amount of housed ribbon. To this end, the supply and take-up spools are located upon different levels in order to allow an overlap condition to exist. The desired result is satisfactorily achieved, however, the cartridge is quite bulky because of the bi-level arrangement. Furthermore, the problems inherent in conventional arrangements with fixed spool centers and tension drive, also are present in this cartridge. Briefly stated, these are caused by the fact that the ribbon originates upon a fixed center supply spool from which it is despooled and fed out of the housing, across a useful span and then returned to the interior of the housing for collection upon a fixed center take-up spool. A capstan drive mechanism rotates the take-up spool, thus drawing the ribbon along its path of travel. In so doing, sufficient tension must be applied to the ribbon to rotate the supply spool and to overcome all drag forces along its path of travel. The relatively high tension necessitates a high driving torque and increases the likelihood of ribbon breakage.

In order to realize the benefits of the high volume surface drive ribbon cartride arrangement of the above-identified copending application in a commercial product, its principle of operation was sought to be incorporated into the common envelope of the HyType II ribbon cartridges. Severe constraints imposed by the relatively small envelope periphery and the location of external machine driving elements, with which cartridge drive elements must cooperate, were overcome. In addition to spatial demands, an overall cost reduction has been achieved by a substantial decrease in the number of components.

The present invention provides an improved ribbon cartridge, for use in impact printers or typewriters, in which inked ribbon upon a supply spool and a takeup spool are enclosed within a housing with the center of each spool being supported for rotation and for floating movement along its guide path. A fixed center drive capstan is also located within the housing. The supply spool is mounted upon a torsion arm for movement in an arcuate path and is urged against the take-up spool which is constrained to move in a straight line between the take-up spool and the fixed center capstan which, upon rotation, drives the take-up spool for winding ribbon thereon while simultaneously unwinding ribbon from the supply spool.

A number of advantages have resulted from this unique ribbon cartridge configuration. First, the floating center arrangement incorporating an arcuately moveable supply spool and a linearly translating takeup spool allows the supply and take-up spools to share space within the confines of the known HyType II housing envelope as the ribbon is fed off of the former and onto the latter, resulting in a capability of housing substantially more ribbon than was heretofore possible in the conventional HyType II cartridges. Second, this novel combination provides a positive surface drive to the supply spool (directly from the take-up spool) resulting in a lower and more consistent tension throughout the length of the ribbon. Third, the driving power requirements of the cartridge are decreased because of the reduced hold-back torque requirements of the supply spool. The resultant and more constant ribbon tension allows thinner and thus less strong ribbon to be successfully utilized, yielding a further ribbon capacity advantage. And fourth, ribbon payout (linear displacement) is constant and proportional to the drive capstan angular displacement throughout the ribbon length because of the direct surface drive, in contrast to conventional takeup hub center drive systems wherein the ribbon is despooled at a variable rate in proportion to the take-up spool outer diameter. The unique placement of alternative drive capstan elements further allows different angular displacements to be easily obtained from a constant drive motor, thus achieving different rates of incremental ribbon advance as required for single strike, ultra high quality printing or for multi-strike, conventional office usage.

A more complete understanding of the invention and its advantages will be clear from the following description and claims taken with the accompanying drawings, wherein:

Figure 1:
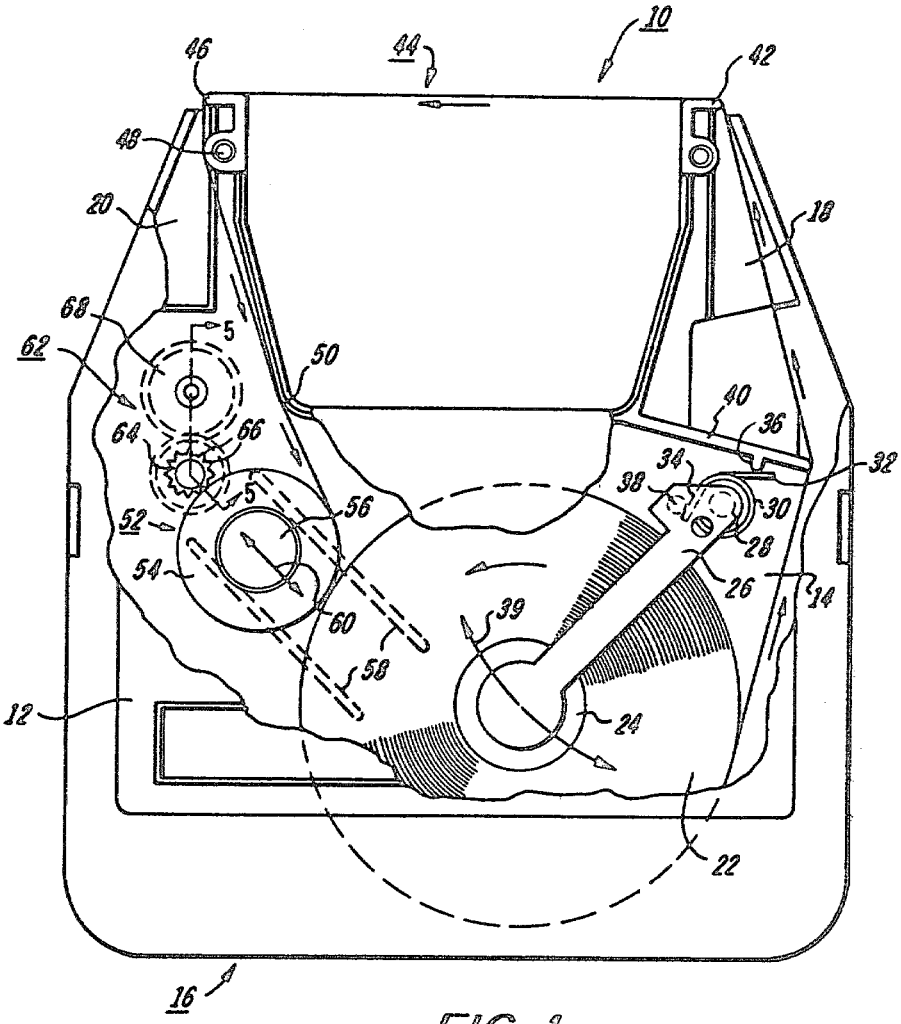
FIG. 1 is a schematic representation of the improved ribbon cartridge of this invention showing the relationship of the supply spool and takeup spool at the beginning of ribbon usage.
Figure 2:
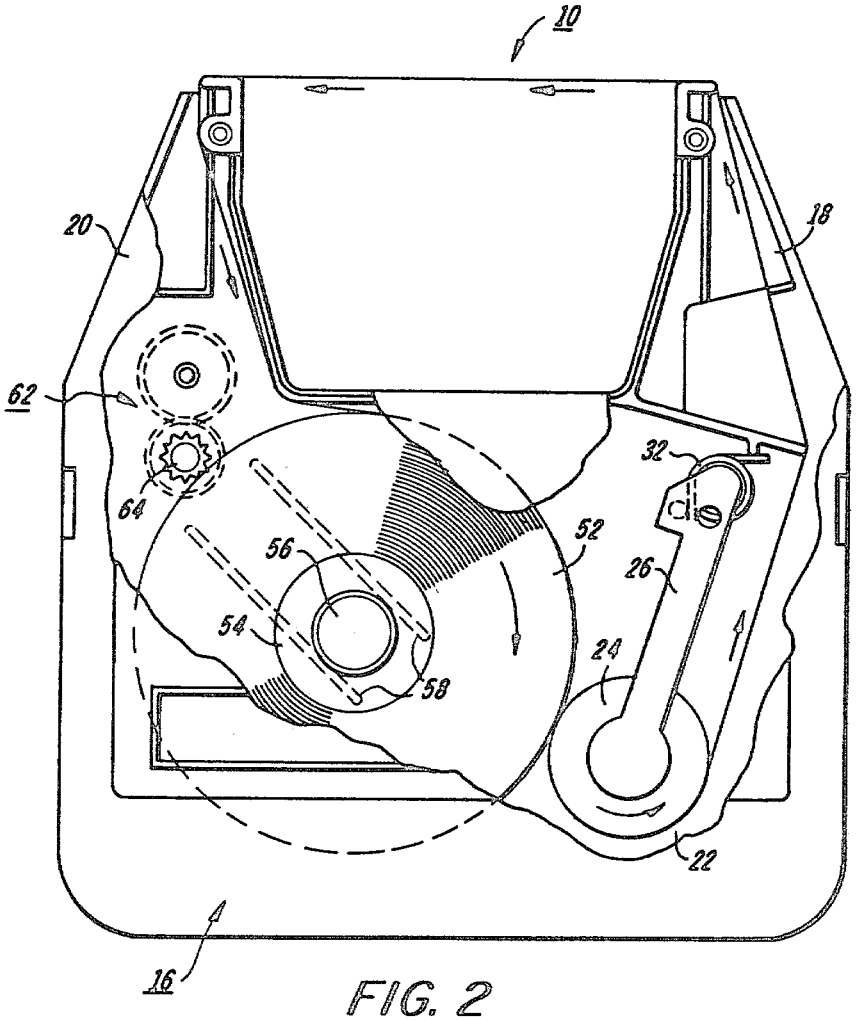
FIG. 2 is a view similar to that of FIG. 1 showing substantially all of the ribbon having been despooled from the supply spool and wound upon the takeup spool.

Turning to the drawings, there is illustrated in FIGS. 1 and 2 a ribbon cartridge 10 adapted to be accepted within a Diablo HyType II printer. The housing envelope is of the same size (as viewed in the direction of these figures) and the ribbon drive connection is located in the same place as in the now presently available cartridges. In general terms, the cartridge 10 comprises a housing made up of planar top and base walls 12 and 14, respectively, separated by side walls (not shown), portions of which are molded integrally with either the top or bottom. The housing includes a major body cavity 16, within which the ribbon is stored, an outlet horn 18 and an inlet horn 20.

A supply spool 22 of plastic film ribbon is mounted upon a hub 24 for rotation about its center carried at the free end of a torsion arm 26. The opposite end of the arm is fixed for angular movement by an integral cylindrical sleeve (not shown) being seated upon a mating cylindrical pivot pin (also not shown) formed in the housing base wall 14, both the sleeve and the pivot pin located in the area indicated by dotted circle 28. A torsion spring 30 having outwardly extending biasing arms 32 and 34, encircles the cylindrical sleeve with arm 32 biased against a protrusion 36 of the housing base 14 and arm 34 biased against a pin 38 on the underside of the torsion arm 26. Thus, the spring 30 urges the torsion arm 26 and supply spool 22 carried thereon to move along a path shown by arrow 39 in a clockwise direction about the pivot point defined by the fixed end of the arm.

The free, nonwound, length of plastic film ribbon extends from the periphery of supply spool 22 over the end of guide wall 40, formed on the housing base 14, and through the outlet horns 18. At the outer end of horn 18, the ribbon passes over outlet guide 42 across the impact zone 44 and around inlet guide 46. Ribbon reenters the housing through inlet horn 20 and passes to the major body cavity 16 over guide surfaces 48 and 50 to take-up spool 52.

Take-up spool 52 includes a hub 54 upon which the film ribbon is wound. The hub is free to rotate about its center and has an axial extension 56 restrained in tracks 58 (shown in phantom lines) formed on the inside surface of the planar top wall member 12. The path of movement of the take-up spool 52 within the tracks 58 is shown by arrow 60.

A speed reducing drive capstan assembly 62, including a spiked capstan 64 with radially extending spikes or teeth 66 contacts the periphery of take-up spool 52 for positive driving rotation. In order to achieve the desired multistrike ribbon incrementation from the external machine drive, there is provided a speed reducing gear train arrangement including idler gear 68.

The supply spool 22 is always held in surface contact with the takeup hub 54 by the torsion arm 26 under the influence of torsion spring 30. In turn, the take-up hub 54 is always held in contact with the teeth 66 of the spiked capstan 64, also under the biasing influence of the torsion spring 30. This spring force, which is applied to the supply spool through the torsion arm, maintains adequate surface friction between the peripheral surfaces of the two ribbon spools so that a positive ribbon despooling and take-up winding is insured during capstan rotation. A further design feature utilized to prevent inadvertant despooling from the supply spool 22, is the provision of a drag force established between the contacting surfaces of the ribbon pancake of the supply spool and the under surface of the torsion arm 26. These contacting surfaces create the necessary friction for nominal ribbon tension desired by the system.

Turning now to FIG. 2, wherein the ribbon has substantially completely passed from the supply spool 22 to the take-up spool 52, it can be readily seen that the floating center arrangement allows the supply and takeup spools to share the same areas within the major body cavity 16 of the housing during the ribbon transfer cycle. This design has resulted in a great increase of ribbon footage within the HyType II cartridge. For example, in the HyType II cartridge, disclosed in U.S. Pat. No. 4,034,935, approximately 390 feet of ribbon was packed within the housing, whereas this invention allows 450 feet of the same thickness ribbon to be packed, a 15% increase in ribbon footage. A further increase in ribbon footage is made possible by the use of thinner ribbon since the positive surface drive places substantially less tension on the free span of ribbon as compared to the conventional cartridges.

Figure 3:
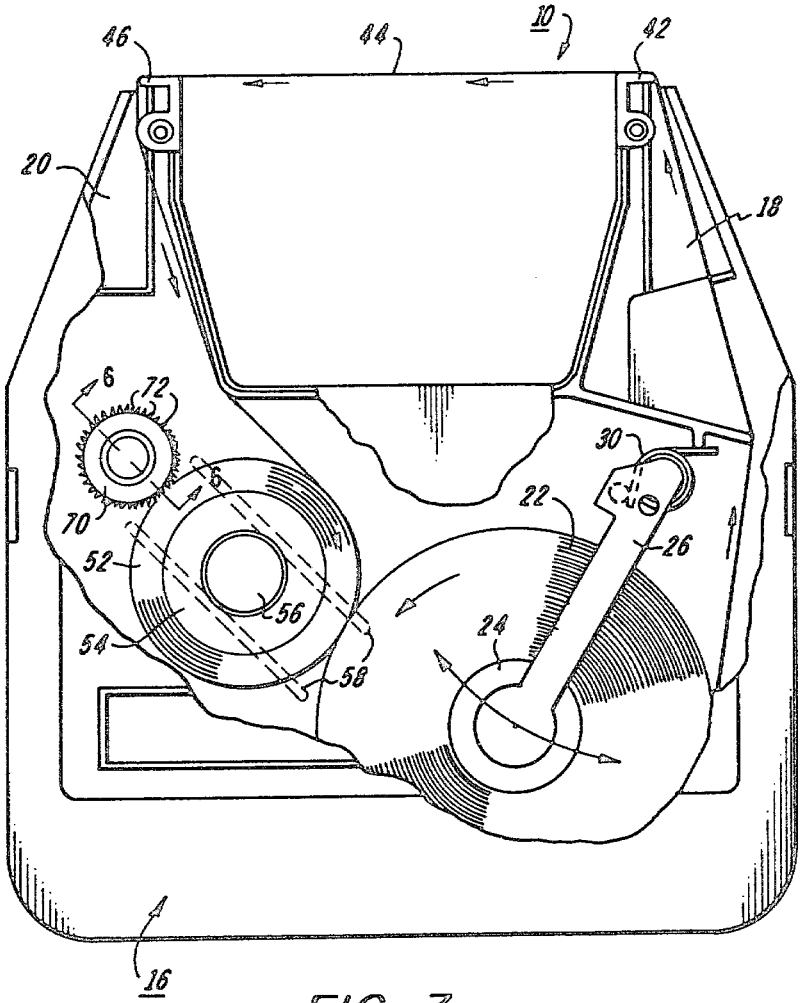
FIG. 3 is a view similar to that of FIGS. 1 and 2 showing an intermediate ribbon despooled condition and also showing an alternative drive arrangement.

In FIG. 3 an intermediate level of ribbon usage is illustrated. Also disclosed is an alternative drive arrangement for single strike ribbon incrementation. A single spiked capstan spindle 70, bearing a plurality of radially extending peripheral spikes or teeth 72, cooperates with take-up spool 52 for driving it. Using this drive embodiment with the larger outside diameter the total ribbon footage available in the housing is 400 feet.

Figure 4:
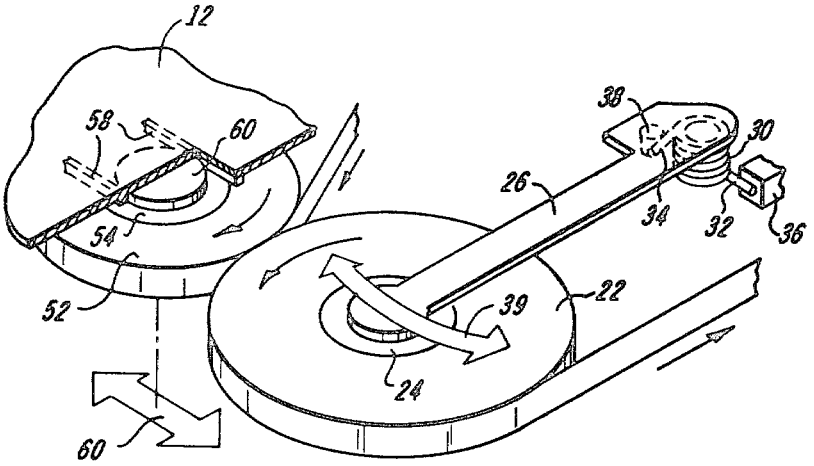
FIG. 4 is a partial perspective view showing the supply and takeup spools and their paths of movement.
Figure 6:
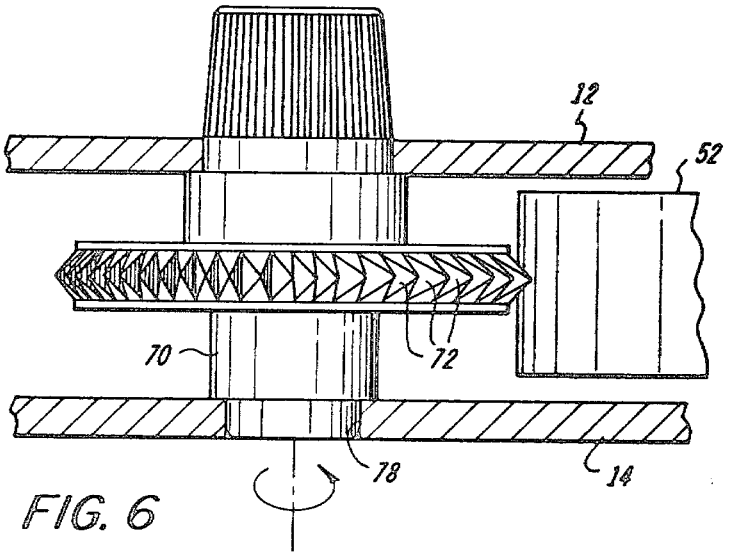
FIG. 6 is an enlarged sectional view taken substantially along line 5—5 of FIG. 3 showing the alternative drive capstan.

The directions of spool movement are more clearly shown in the schematic perspective view of FIG. 4. Supply spool 22 moves in an arc upon torsion arm 26 under the influence of torsion spring 30 and take-up spool 52 moves in the straight path defined by the tracks 58 formed on the inside surface of top wall 12.

An advantageous feature of the ribbon cartridge of the present invention is the simplicity with which the cartridge can be assembled to function in either the multi-strike mode or the single strike mode. In the more common (general office use) multi-strike mode the ribbon is laterally incremented by an amount less than the average character width. In other words, there are multiple overstrikes upon a given area, with the inked ribbon losing a portion of its ink at each overstrike. On the other hand, extremely high quality copy may be achieved in the less commonly used single strike mode (e.g. offset master preparation) wherein the ribbon is incremented by slightly more than an average character width after all of the inked coating in the impact zone is sheared off the ribbon.

Figure 5:
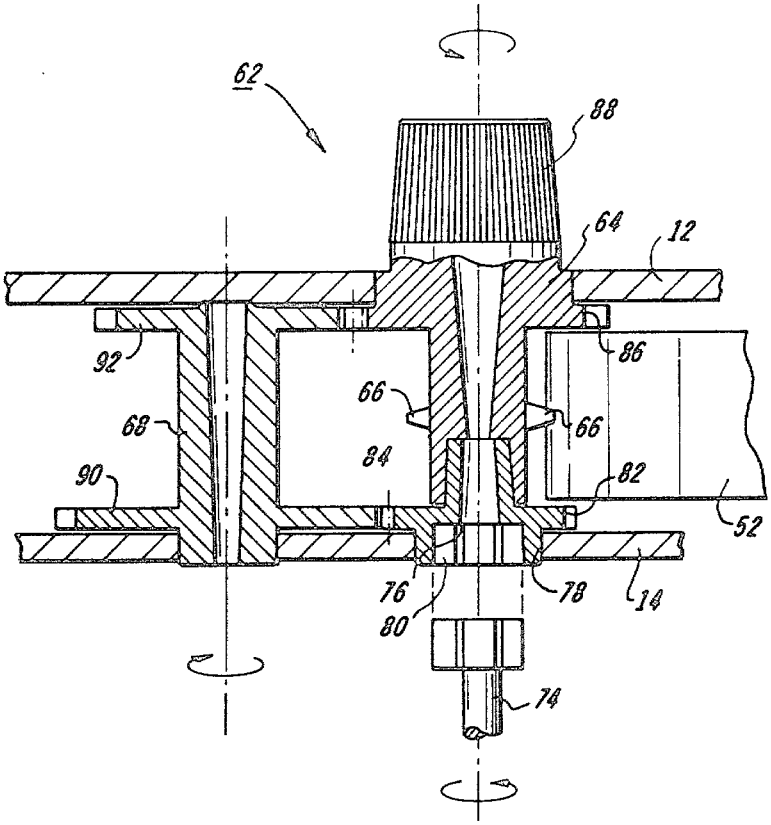
FIG. 5 is an enlarged sectional view taken substantially along line 4—4 of FIG. 1 showing the speed reducing drive capstan arrangement.

In FIG. 5, the multi-strike capstan drive train assembly 62 is clearly shown. Also shown, is the driving element 74 driven by a ribbon drive motor (not shown). A drive pinion 76, seated in an opening 78 in the housing base wall 14 has a cruciform aperture 80 for receiving the mating drive element 74 when the cartridge is mounted on the printer. The pinion 76 further includes a gear 82 and an inwardly tapered cylindrical body 84. Seated upon the tapered body of the pinion is the spiked capstan 64 which also includes a gear 86 and terminates in a knurled head 88, provided for manual manipulation of the capstan when necessary. Motion is imparted to the capstan 64 from the drive pinion through an idler 68 provided with lower and upper gears 90 and 92 which engage pinion gear 82 and capstan gear 86, respectively. The desired linear incrementation may be achieved by proper selection of the gear ratios and the outside diameter of the circumferential teeth 66.

During assembly, by simply inserting the single strike capstan spinkle 70 in the opening 78 the ribbon cartridge will be usable in the single strike mode. It should be noted that the outside diameter of the circumferential teeth 72 is substantially larger than its multi-strike counterpart for greater linear incrementation of the ribbon.

From the foregoing it should be appreciated that the unique ribbon cartridge of the present invention has advanced the art. The supply spool and take-up spool have each been constrained for floating motion along its own path such that the maximum amount of ribbon may be housed within a confined enclosure, the spools sharing area during their movement. A simple and inexpensive biasing arrangement is also provided by the torsion spring which imparts arcuate movement to the supply spool mounted upon the end of the torsion arm. Finally, the invention also comprehends an easily convertible ribbon cartridge which may be assembled to function in either the multi-strike mode or the single strike mode by merely introducing one or another capstan element.

It should be understood that the present disclosure has been made only by way of example and that numerous changes in details of construction and the combination and arrangement of parts may be resorted to without departing from the true spirit and scope of the invention as hereinafter claimed.

What is claimed is:

1. A ribbon cartridge for use in impact printers, including a housing having substantially planar opposed walls between which there is enclosed a supply spool, a take-up spool and a length of inked ribbon mounted upon said supply spool and extending in a path out of said housing across an impact zone and back into said housing to said take-up spool, said cartridge being characterized by comprising drive means in contact with the surface of said take-up spool for rotating said spool, said drive means having a fixed center about which it rotates, a pivot arm fixed at one end and supporting upon its opposite, arcuately movable, end said supply spool for movement in an arc while allowing said supply spool to rotate about its center, guide means in said housing for confining said take-up spool for floating movement along a path between said supply spool and said drive means while allowing said takeup spool to rotate about its center, and means for urging said supply spool for arcuate movement toward and against said take-up spool and for urging said take-up spool along its path of movement into contact with said fixed center drive means.

2. The ribbon cartridge defined in claim 1 characterized in that said means for urging comprising a torsion spring positioned at the fixed end of said pivot arm.

3. The ribbon cartride defined in claim 1 characterized in that said guide means in said housing comprises a pair of tracks formed on one of said walls.

4. The ribbon cartridge defined in claim 3 characterized in that said take-up spool includes a hub having an axially extending portion confined between said tracks.

5. The ribbon cartridge defined in claim 1 characterized in that said drive means includes a spiked drive capstan.

6. The ribbon cartridge defined in claim 5 characterized in that said drive means further includes a speed reducing gear train cooperable with said spiked drive capstan.

7. The ribbon cartridge defined in claim 1 characterized in that the side of said pivot arm facing the ribbon mounted upon said supply spool is in contact therewith for providing a drag force to inhibit despooling.

* * * * *